US012077329B2

(12) United States Patent
Empl et al.

(10) Patent No.: US 12,077,329 B2
(45) Date of Patent: Sep. 3, 2024

(54) CARTRIDGE SYSTEM AND METHOD FOR PRODUCING A CARTRIDGE SYSTEM

(71) Applicant: Freezio AG, Amriswil (CH)

(72) Inventors: Günter Empl, Bergisch Gladbach (DE); Marc Krüger, Bergisch Gladbach (DE)

(73) Assignee: Freezio AG, Amriswil (CH)

( * ) Notice: Subject to any disclaimer, the term of this patent is extended or adjusted under 35 U.S.C. 154(b) by 132 days.

(21) Appl. No.: 17/628,648

(22) PCT Filed: Jul. 24, 2020

(86) PCT No.: PCT/EP2020/070927

§ 371 (c)(1),
(2) Date: Jan. 20, 2022

(87) PCT Pub. No.: WO2021/018760

PCT Pub. Date: Feb. 4, 2021

(65) Prior Publication Data

US 2022/0274725 A1 Sep. 1, 2022

(30) Foreign Application Priority Data

Jul. 26, 2019 (DE) ..... 102019211189.0
Aug. 23, 2019 (DE) ..... 102019212708.8

(51) Int. Cl.
*B65B 29/02* (2006.01)
*B21D 22/28* (2006.01)
*B65B 61/18* (2006.01)

(52) U.S. Cl.
CPC ..... *B65B 29/022* (2017.08); *B21D 22/28* (2013.01); *B65B 61/18* (2013.01)

(58) Field of Classification Search
CPC ..... B65B 29/022; B65B 29/025; B65B 29/02; B65D 85/8046; B65D 85/8043; B67D 1/0046
USPC ..... 53/421, 445, 467; 99/295, 323; 426/394
See application file for complete search history.

(56) References Cited

U.S. PATENT DOCUMENTS 6,810,788 B2 * 11/2004 Hale ..... B65D 85/8061 426/77
8,039,034 B2 * 10/2011 Ozanne ..... A47J 31/3628 426/431

(Continued)

FOREIGN PATENT DOCUMENTS

CN 106998935 A 8/2017
EP 2017221 A1 1/2009

(Continued)

OTHER PUBLICATIONS

International Search Report and Written Opinion dated Oct. 23, 2020, for International Application PCT/EP2020/070927.

(Continued)

*Primary Examiner* — Valentin Neacsu
(74) *Attorney, Agent, or Firm* — The Dobrusin Law Firm, P.C.

(57) ABSTRACT

A method for producing a cartridge system for producing a beverage, where the cartridge system is insertable into a beverage preparation machine and has a cartridge with a reservoir filled with a beverage substance and a cartridge receptacle connected to the cartridge. The cartridge receptacle has a mixing chamber and a fluid feed opening into the mixing chamber. An aluminum sheet is provided in a first step. A main body is generated at least partially from the aluminum sheet by punching and either deep-drawing or impact extrusion in a second step. A sealing element is attached to the main body in a third step. The main body is connected to the cartridge receptacle in a fourth step.

17 Claims, 4 Drawing Sheets

(56) References Cited

U.S. PATENT DOCUMENTS

| | | | | |
|---|---|---|---|---|
| 9,487,348 | B2 * | 11/2016 | Roberts | A23L 3/36 |
| 9,675,203 | B2 * | 6/2017 | Roberts | A47J 31/462 |
| 2003/0192615 | A1 | 10/2003 | Smith et al. | |
| 2003/0222089 | A1 * | 12/2003 | Hale | B65D 85/8061 220/574 |
| 2007/0175335 | A1 * | 8/2007 | Liverani | A47J 31/3695 99/279 |
| 2013/0167733 | A1 * | 7/2013 | Mahlich | A47J 31/3633 99/295 |
| 2013/0327222 | A1 * | 12/2013 | Mahlich | A47J 31/407 99/295 |
| 2019/0023552 | A1 * | 1/2019 | Krüger | B65D 85/8055 |
| 2019/0225476 | A1 * | 7/2019 | Krüger | B65D 51/226 |
| 2022/0274725 | A1 * | 9/2022 | Empl | B67D 1/0079 |

FOREIGN PATENT DOCUMENTS

| | | | |
|---|---|---|---|
| EP | 3225684 | A1 | 10/2017 |
| EP | 3434159 | A1 | 1/2019 |
| JP | 2000262405 | A | 9/2000 |
| WO | 9636557 | A1 | 11/1996 |
| WO | 03045832 | A1 | 6/2003 |
| WO | 2017/121796 | A1 | 7/2017 |
| WO | 2017/121797 | A1 | 7/2017 |
| WO | 2017/121798 | A1 | 7/2017 |
| WO | 2017/121799 | A1 | 7/2017 |
| WO | 2017/121801 | A1 | 7/2017 |
| WO | 2017/121802 | A1 | 7/2017 |
| WO | 2019/002293 | A1 | 1/2019 |
| WO | 2019/101997 | A1 | 5/2019 |

OTHER PUBLICATIONS

Chinese First Examination Report dated Aug. 1, 2023, for Chinese Application 2020800533137.

English Translation of International Preliminary Report on Patentability dated Nov. 5, 2021, for International Application PCT/EP2020/070927.

* cited by examiner

CARTRIDGE SYSTEM AND METHOD FOR PRODUCING A CARTRIDGE SYSTEM

PRIOR ART

The present invention proceeds from a cartridge system for producing a beverage, wherein the cartridge system is insertable into a beverage preparation machine, has a cartridge comprising a reservoir filled with a beverage substance, and has a cartridge receptacle connected to the cartridge, wherein the cartridge receptacle has a mixing chamber fluidly connectable to the reservoir and a fluid feed opening into the mixing chamber.

Such systems are known from the prior art, for example, from the documents WO 2017/121 802 A1, WO 2017/121 801 A1, WO 2017/121 801 A1, WO 2017/121 799 A1, WO 2017/121 798 A1, WO 2017/121 797 A1, WO 2017/121 796 A1 und WO 2019/002 293 A1 and are used to produce beverages from pre-portioned cartridges. The production of beverages with such systems is extremely convenient for the user, since he only has to insert a cartridge and press a start button. The beverage preparation machine then takes over making the same in a fully automated manner, that is to say in particular that the beverage substance is mixed with a predetermined amount of liquid, in particular cold and carbonated water, and is introduced into a drinking vessel. In this way, mixed beverages in particular can be produced much more easily, quickly and with little effort for the user. The user can in this case select from a large number of different cartridges, so that he can produce different drinks as desired.

A major challenge in such systems is to minimize the reference time, i.e. the time required from the start of the beverage production process by the user to produce the finished beverage, in order to increase user convenience. Furthermore, another challenge is to provide sufficient beverage substance as well as sufficient carbon dioxide for a beverage with an appealing taste, especially during this reference time to be minimized.

SUMMARY OF THE INVENTION

Therefore, it is an object of the present invention to provide a cartridge system for the production of a beverage in a beverage preparation machine, in which the production of a beverage with an appealing taste is achieved with a minimum of reference time.

This object is achieved by a cartridge system according to claim 1.

Compared with the prior art, the cartridge system according to the invention has the advantage that the cartridge is not made of plastic but of aluminum. The cartridge is therefore much more stable and can withstand a higher internal pressure. The in particular liquid beverage substance can thus be enclosed in the reservoir under a higher pressure without causing damage or deformation of the cartridge. It is thus possible to keep liquid beverage substances with a higher carbon dioxide content in the reservoir without the risk of the reservoir bursting due to the carbon dioxide in the event of vibrations, for example during transport or storage of the cartridge system. The higher carbon dioxide content in turn has a positive effect both on the taste of the beverage to be produced and on the best-before date of the cartridge. Another advantage of the cartridge system according to the invention is that the reservoir can be emptied at a higher pressure during the beverage production process. This can significantly reduce the time required for the beverage to be produced, without the risk of impairing the taste of the beverage. In order to achieve the desired stability, the cartridge has a main body made of aluminum, which in its typical wall region preferably has a wall thickness of between 0.01 and 0.5 millimeters, preferably between 0.01 and 0.2 millimeters, particularly preferably between 0.03 and 0.1 millimeters and most preferably of essentially 0.05 millimeters, in particular with a defect tolerance of no more than 15%. The cartridge is then preferably configured such that it can withstand an internal pressure of up to 10 bar, particularly preferably up to 8 bar and most preferably up to 6 bar without bursting (at a temperature of 20° C. and an external pressure of 1 bar). The reservoir thereby preferably comprises a volume of between 10 and 500 milliliters, particularly preferably between 30 and 90 milliliters and most preferably of substantially 60 milliliters. In particular, the cartridge system comprises a liquid beverage substance which is preferably carbonated. Particularly preferably, the liquid beverage substance comprises a beverage concentrate, in particular a syrup.

According to a preferred embodiment of the present invention, provision is made for the cartridge to comprise a cup-shaped main body. The cup-shaped main body is preferably produced by deep-drawing or impact extrusion, which advantageously enables comparatively inexpensive and rapid production. In particular, the cartridge is thus necessarily hermetically sealed on one side, whereby a particularly stable configuration of the cartridge is realized. Preferably, the main body is cup-shaped with a cylindrical cartridge wall, which is closed on one side by a cartridge bottom, wherein the cartridge wall and the cartridge bottom are formed in particular in one piece. It is conceivable that the cartridge wall and the cartridge bottom consist of one piece and in particular both of aluminum, in that the main body is deep-drawn from a sheet of aluminum.

As an alternative to deep drawing or impact extrusion, the main body can also be formed by bending an aluminum sheet into a cylindrical tube and then bonding, welding and/or pressing the abutting sides of the aluminum sheet bent into the tube together to produce a main body with a longitudinal seam. In addition, the cartridge bottom is formed as a separate lid body, in particular by deep drawing or impact extrusion of a further aluminum sheet. This cartridge bottom, which is configured as a separate lid body, can then be slipped over that end of the cartridge wall which is bent towards the tube and faces away from the cartridge receptacle, and can there be circumferentially bonded, welded and/or pressed to the cartridge wall. In particular, the lid body is crimped onto the tubular cartridge wall to form the cartridge bottom.

According to a preferred embodiment of the present invention, provision is made for the main body to be closed in its initial position on its side opposite the cartridge bottom by a sealing element. In a preferred manner, the sealing element ensures that the beverage substance remains within the reservoir before the start of the beverage production process, where it is hermetically sealed for long shelf life and consistent flavor.

According to a preferred embodiment of the present invention, provision is made for the sealing element to have a particularly rigid or semi-rigid sealing body with a pre-punched hole. In the area of the pre-punched hole, a partial area of the sealing body is partially punched. This means that the partial region is not completely punched from the sealing element, but is only partially punched, so that in the initial state of the cartridge it still remains integrally connected to the rest of the sealing element in its corner regions. Thus, the reservoir 6 remains hermetically sealed in the initial state. The sealing element here is in particular the sealing body made of aluminum. The size of the punched hole preferably corresponds essentially to the through-opening in the sealing element to be created later by the piercing spike. Preferably, a predetermined breaking point is formed in an edge region of the partial area by the partial punched hole in relation to the rest of the sealing body, which tears open at least partially when the partial area comes into contact with a piercing spike of the beverage preparation machine (see below) in order to release the through-opening. Since the partial area is punched out of the sealing body, it has essentially the same size or diameter as the through-opening, in which the piercing spike is also arranged during beverage production. This advantageously prevents the detached partial area from passing through the through-opening 18' into the mixing chamber 8.

According to a further preferred embodiment of the present invention, provision is made for the sealing element to have an in particular rigid or semi-rigid sealing body with a through-opening. In particular, the sealing element is made of aluminum and is attached to the main body. It is conceivable for the sealing body to be crimped, bonded, clamped, welded and/or pressed to the main body. The through-opening is formed either centrally or offset from the center in the sealing body. The sealing body is thus disk-shaped and/or ring-shaped. Alternatively, it is conceivable for the sealing body also to be cup-shaped, with the peripheral part projecting from the cup bottom running parallel to the cartridge wall and being pressed or crimped to this part of the cartridge wall. In particular, the part projecting from the cup base is arranged on the inner side of the cartridge wall in order to give the cartridge an aesthetically pleasing outer appearance. In its typical wall region, the sealing body preferably has a wall thickness of between 0.09 and 0.5 millimeters, preferably between 0.1 and 0.3 millimeters, particularly preferably between 0.15 and 0.25 millimeters and most preferably of essentially 0.2 millimeters, in particular with a maximum defect tolerance of 15%.

According to a preferred embodiment of the present invention, provision is made for the sealing element to comprise a sealing foil which closes the through-opening in the initial position of the cartridge system, wherein the sealing foil is preferably a plastic foil, an aluminum foil or a multilayer foil made of plastic and/or aluminum. In this way, despite the through-opening in the sealing body, a hermetic seal of the reservoir is achieved, wherein during the beverage production process the sealing foil can be easily perforated by a piercing spike (see below) of the cartridge receptacle in order to transfer the beverage substance from the reservoir into the mixing chamber of the cartridge receptacle as quickly as possible. Preferably, a circumferential edge of the sealing foil is attached to the sealing element, in particular bonded, sealed and/or welded.

According to a preferred alternative embodiment of the present invention, provision is made for the sealing element to comprise a sealing foil, preferably a plastic foil, an aluminum foil or a multilayer foil made of plastic and/or aluminum, which is attached in particular to the edge of the cartridge wall. In this embodiment, the sealing element does not have an additional sealing body, but the opening of the main body is hermetically sealed directly and in particular exclusively by the sealing foil, which is attached directly to the edge of the cartridge wall. Preferably, a circumferential peripheral fastening region of the sealing element is crimped, bonded, sealed and/or welded to the cartridge wall and in particular to the edge of the cartridge wall.

It is conceivable for the fastening region to extend at least partially parallel to the cartridge wall on the inside or outside of the cartridge wall. In this case, the sealing foil is also cup-shaped or formed. It is conceivable for the sealing foil also to be deep-drawn into this shape.

The sealing body of the sealing element could also be configured as a type of crimp cap. It is conceivable for the cartridge wall to comprise a circumferential rim around which the sealing body is crimped for attachment to the cartridge. Alternatively, the sealing element could be screwed onto the end of the cartridge. For this purpose, a fastening region of the cartridge is provided in particular with an external thread onto which the sealing body is screwed. For this purpose, the sealing body has in particular an internal thread complementary to the external thread. The screw connection is preferably adapted such that only screwing on with subsequent latching is possible, so that subsequent unscrewing is prevented by the latching.

According to a preferred alternative embodiment of the present invention, provision is made for a connecting means, in particular a latching bead, a latching bulge or an undercut, to be provided at the edge of the cartridge wall, in particular circumferentially, for connecting the cartridge to the sealing element and/or the cartridge receptacle. Preferably, the sealing element and/or the cartridge receptacle has a mating connecting means, in particular a further latching bead, a latching bulge or an undercut, which is in particular complementary to the connecting means and is connected to the connecting means in a form-fitting, force-fitting and/or material-fitting manner. Preferably, a stable and inexpensive connection between the cartridge and the cartridge receptacle and/or between the cartridge and the sealing element can thus be achieved.

According to a preferred alternative embodiment of the present invention, provision is made for the fastening region to be arranged at least partially between the connecting means and the mating connecting means, and in particular to be clamped, welded and/or bonded in place. In a preferred manner, the sealing element, in particular the edge of the sealing body or the edge of the sealing foil, is additionally fixed between the connecting means and the mating connecting means, i.e. from both sides, during the beverage production process. A comparatively large overpressure can thus be generated inside the reservoir without the risk of the sealing element detaching from the cartridge wall. Alternatively, it is also conceivable for the fastening region to be located on the inside of the cartridge wall, so that the edge of the cartridge wall is arranged between the fastening region and the cartridge receptacle. In this case, therefore, the connecting means is arranged between the fastening means and the mating connecting means. In this way, too, a particularly stable connection can be achieved between the main body, cartridge receptacle and sealing element. In addition, the preferably circumferential connecting means and/or mating connecting means of this embodiment can also be configured as a latching bead, latching bulge, undercut or the like. It is particularly preferred that both the fastening region of the sealing element and the edge region of the sealing foil are arranged between the connecting means and the mating connecting means.

It is conceivable for the cartridge wall or sealing element to comprise a circumferential rim around which the wall of the cartridge receptacle is crimped.

Alternatively, the cartridge receptacle could be screwed onto the end of the cartridge or onto the sealing element. For this purpose, a fastening region of the cartridge or the sealing element is provided in particular with an external thread onto which the cartridge receptacle is screwed. For this purpose, the cartridge receptacle has an internal thread complementary to the external thread. The screw connection is preferably adapted such that only screwing on with subsequent latching is possible, so that subsequent unscrewing is prevented by the latching.

According to a preferred alternative embodiment of the present invention, provision is made for the cartridge receptacle to have a basic structure which is preferably made at least partially and in particular entirely of plastic. This advantageously achieves a low-cost production. In particular, the basic structure has a cup-shaped configuration the open side of which is aligned in the direction of the cartridge, wherein a beverage outlet opening and an outwardly open spike guide are formed on a bottom side opposite the cartridge, and wherein a fluid feed is formed on the bottom side or a side wall of the basic structure. This cartridge receptacle has the advantage that the fluid feed does not open into the reservoir of the cartridge, but into the mixing chamber separated from the reservoir. This prevents the fluid feed from causing back contamination of the beverage preparation machine during the beverage preparation process. For this purpose, the reservoir is not flushed by the fluid, but rather the beverage substance and the fluid enter the mixing chamber of the cartridge receptacle separately from each other. The fluid is led directly into the mixing chamber, while the beverage substance is transferred into the mixing chamber independently of the fluid. In particular, a displaceably mounted piercing spike is arranged within the spike guide for this purpose, wherein the piercing spike is displaceable between a retracted position, in which the piercing spike is spaced apart from the sealing element and in particular the sealing foil (or the partial area), and an extended position, in which the piercing spike pierces the sealing element and in particular the sealing foil (or partially or completely tears off the partial area from the sealing element) and projects into the reservoir. In the initial state of the cartridge system, the piercing spike is thus in the retracted position so that the reservoir is hermetically sealed by the sealing element and, in particular, the sealing foil, and can be transferred from the retracted position to the extended position to open the sealing element of the cartridge. In the extended position, the sealing element is perforated by the piercing spike or a pre-punched hole is torn open so that the beverage substance passes the sealing element through in particular at least one lateral channel on the piercing spike into the mixing chamber. Thus, a simple and reliable opening of a previously aroma-tight sealed cartridge in a beverage preparation machine is made possible. In addition, it has been shown that back-contamination of the beverage preparation machine is prevented, in particular because no overpressure acting directly on the fluid feed is generated in the reservoir. The configuration of the mixing chamber in the cartridge receptacle, which is reversibly insertable into the beverage preparation machine, advantageously ensures that the mixing chamber is part of the replaceable cartridge system. In this way, contamination of the beverage preparation machine by the beverage substance is effectively avoided because only parts of the replaceable disposable or reusable cartridge system come into contact with the beverage substance.

According to a preferred embodiment of the present invention, provision is made for the cartridge system and in particular the cartridge receptacle to have at least one support structure which supports the sealing foil in the direction of the cartridge receptacle and in particular in the direction of the mixing cartridge. In this way, tearing of the sealing foil is prevented, in particular during pressure build-up in the reservoir during the beverage production process. The support structure comprises in particular a column-, bridge-, grid- or cylinder-shaped structure which projects from the bottom of the mixing chamber in the direction of the reservoir and on which the sealing foil partially rests.

According to a preferred embodiment of the present invention, provision is made for the piercing spike to comprise a cylindrical or frustoconical base part and a piercing part extending in the direction of the reservoir, wherein the piercing part is configured in the form of an obliquely cut truncated cone. Preferably, the piercing part is further configured such that an oblique cut surface of the obliquely cut truncated cone substantially faces the reservoir, wherein the oval periphery of the cut surface at least partially constitutes a cut edge for perforating the sealing element. It has been shown that the cut surface, which is generated by an oblique cut through the truncated cone, on the one hand cuts the sealing element easily and with sufficiently little force, and on the other hand does not separate any chips or loose pieces from the sealing element, which would otherwise contaminate the beverage in an undesirable manner. The sealing element perforation advantageously looks such that on that side of the piercing spike on which the maximum cutting edge projecting in the direction of the reservoir is formed, the material of the sealing element is cut with a smooth cut, while in the region of the cut surface of the piercing part the cut-off material of the sealing element is still connected to the remaining sealing element and is preferably rolled up or folded.

Preferably, the piercing spike comprises an intermediate part arranged between the base part and the piercing part, which is frustoconical in shape, wherein a circumferential shoulder is formed between the base part and the intermediate part and wherein a circumferential edge is formed between the piercing part and the intermediate part. Advantageously, a stable piercing spike is thus formed. The formation of the edge has the advantage that the lateral channels, insofar as they extend over the edge, have an enlarged entrance on the reservoir side and thus the transfer of the beverage substance in the direction of the mixing chamber is facilitated. The shoulder serves to abut against a stop of the spike guide when the piercing spike is in the retracted position, thus limiting the extension movement of the piercing spike in the direction of the cartridge.

According to a preferred embodiment of the present invention, provision is made for the cartridge receptacle to have a plurality of lateral channels, wherein each lateral channel extends parallel to the piercing spike in the region of the piercing part and in the region of the intermediate part. In this context, the lateral channels are each formed in particular in the form of a groove which is open on one side and is introduced into the outer surface of the piercing spike. Preferably, the lateral channels are at least partially formed in a circumferential region of the piercing spike that is rearward to the cut surface. This has the advantage that the lateral channels are arranged on the side of the sealing element perforation where a cut has been made in the material, and not on the opposite side where the cut material is still connected to the remaining sealing element. The beverage substance can thus flow comparatively un-hindered into the lateral channels.

It is conceivable for the cross-section of the lateral channels and/or the number of lateral channels to be adapted to the viscosity of the beverage substance, so that the lateral channels control or limit the flow of the beverage substance towards the mixing chamber. At a high viscosity, several lateral channels or lateral channels with a larger cross-section are used, while at a lower viscosity, fewer lateral channels or lateral channels with a smaller cross-section are provided. There is thus a suitable cartridge receptacle for each cartridge.

According to a preferred embodiment of the present invention, provision is made for the piercing spike to have a twist prevention means in the form of a web protruding radially from the base part. Twisting of the piercing spike is thus advantageously avoided while it is being transferred from the retracted position into the extended position. It is also ensured that the lateral channels are arranged on that side of the piercing spike which faces away from the beverage outlet of the mixing chamber and in particular faces the fluid feed. In this way, improved mixing of the beverage substance and the fluid within the mixing chamber is achieved.

According to a preferred embodiment of the present invention, provision is made for the piercing spike to have an integrated compressed-air line, which is the cartridge emptying device, wherein the compressed-air line extends along the piercing spike in particular from a first end of the piercing spike to a second end of the piercing spike. In this way, three functions are advantageously integrated into the piercing spike: 1. The piercing spike comprises the piercing part in order to perforate the sealing element and thus to open the cartridge; 2. The piercing spike comprises the lateral channels in order to allow the beverage substance to be transferred into the mixing chamber; 3. The piercing spike comprises the integrated compressed-air line in order to blow compressed air into the reservoir, with the result that the beverage substance is pushed into the mixing chamber under pressure.

Preferably, a compressed-air connection for connecting to a compressed-air source is formed at the second end, and a compressed-air outlet for blowing compressed air into the reservoir is formed at the first end. The cartridge emptying device integrated into the cartridge receptacle thus comprises, within the meaning of the present invention, first of all only one compressed-air line, through which compressed air can be introduced into the reservoir from the outside. The cartridge receptacle is configured such that the beverage substance is pushed out of the reservoir into the mixing chamber by the compressed air. The compressed air is provided in particular by the beverage preparation machine. It is conceivable for a compressed-air source to be coupled directly to the compressed-air connection as soon as the cartridge system is inserted into the beverage preparation machine. This has the advantage that back-contamination in the direction of the beverage preparation machine is effectively avoided because the cartridge emptying device is immediately under pressure when the cartridge system is inserted and thus beverage substance is prevented from traveling in the direction of the compressed-air line and in particular in the direction of the compressed-air source of the beverage preparation machine. The beverage substance can thus move only in the direction of the mixing chamber from the reservoir.

According to a preferred embodiment of the present invention, provision is made for the compressed-air outlet to be configured as an opening in the cut face. This has the advantage that the air flowing into the reservoir is blown in on a side of the piercing spike that is remote from the lateral channels, such that the discharging of the beverage substance into the mixing chamber is not impeded. Preferably, a swirl thus forms in the reservoir, this favoring virtually residue-free emptying of the reservoir.

The compressed-air connection is configured in particular as an opening in the base part, wherein the base part is arranged in the cartridge receptacle such that the compressed-air connection is accessible from outside the cartridge receptacle. In this way, the connection of the compressed-air line to the compressed-air source is favored.

According to a preferred embodiment of the present invention, provision is made for the spike guide to have a guide part with an internal guide channel for receiving the piercing spike, wherein the guide channel of the guide part is configured in a substantially cylindrical or frustoconical manner, and wherein a circumferential stop is formed at an end of the guide part that faces the cartridge, said stop limiting the movement of the piercing spike in the direction of the reservoir, wherein the stop comprises in particular a region with a reduced diameter. In this way, reliable guiding of the piercing spike during the movement from the retracted position into the extended position is advantageously achieved. Preferably, a groove corresponding to the rib is formed as twist prevention means within the wall of the guide channel, such that undesired twisting of the piercing spike is prevented. The guide part is preferably arranged in the mixing chamber and protrudes from a bottom of the mixing chamber in the direction of the cartridge.

According to a preferred embodiment of the present invention, provision is made for the piercing spike to be configured as a plastic part and in particular as an injection-molded plastic part. This allows cost-effective production. In principle, however, it would alternatively also be conceivable to configure the piercing spike as a metal part.

According to a preferred embodiment of the present invention, provision is made for the piercing spike to be configured such that it is transferable from the retracted position into the extended position by a release element of the beverage preparation machine when the cartridge system is inserted into the beverage preparation machine.

According to a further preferred embodiment of the present invention, provision is made for the mixing chamber to have a beverage outlet through which the beverage formed from a blend of the beverage substance with the fluid is discharged, wherein the cartridge system is preferably configured such that the beverage is able to be introduced directly into a portable vessel from the beverage outlet. Advantageously, therefore, neither the beverage substance nor the produced beverage comes into contact with any part of the beverage preparation machine, and so any (back-) contamination of the beverage preparation machine is more or less avoided. The fluid is fed to the mixing chamber separately. Preferably, the fluid is introduced into the mixing chamber under pressure. The fluid is provided in particular by the beverage preparation machine. It is conceivable for a fluid source to be coupled directly to a corresponding fluid connection of the cartridge receptacle as soon as the cartridge system is inserted into the beverage preparation machine. The fluid connection is in this case fluidically connected to the mixing chamber via a fluid line. This has the advantage that back-contamination in the direction of the beverage preparation machine is effectively avoided because the fluid connection is immediately under pressure when the cartridge system is inserted and thus beverage substance is prevented from traveling in the direction of the fluid line and in particular in the direction of the fluid source of the beverage preparation machine. The beverage substance and the beverage can thus move only in the direction of the beverage outlet from the mixing chamber. The fluid comprises in particular water, preferably pressurized, cooled and/or carbonated drinking water.

According to a preferred embodiment of the present invention, provision is made for the mixing chamber to be provided with mixing structures. The mixing structures advantageously ensure improved mixing of beverage substance and fluid. For this purpose, the mixing structures are configured in particular such that the fluid flowing into the mixing chamber is swirled. It is conceivable for the mixing structure to comprise one or more mixing ribs which are arranged in the region of the fluid feed at the bottom of the mixing chamber and extend substantially perpendicular to the direction in which the fluid flows in. The mixing ribs thus act as barriers for the fluid, with the result that the fluid is swirled up and better mixing with the beverage substance is achieved.

According to a further preferred embodiment of the present invention, provision is made for the fluid feed to be supplied with fluid which is cooled by a refrigeration unit, wherein the refrigeration unit is part of the beverage preparation machine or of a separate refrigerator operatively connected to the beverage preparation machine. Advantageously, it is thus possible for cold beverages to be produced even when the cartridge is not cooled and is at room temperature for example. The integration of the system into an existing refrigerator has the advantage that the existing refrigeration unit of the refrigerator can be co-used easily in an efficient manner for the beverage preparation machine. In particular, in what are known as "side-by-side" refrigerators (often also referred to as American refrigerators), sufficient installation space for integrating the system is found in the front. It is conceivable for the beverage preparation machine to be a retrofitting set for such a refrigerator. The refrigeration unit comprises preferably a compressor cooling unit, an absorber cooling unit or a thermoelectric cooler.

According to a further preferred embodiment of the present invention, provision is made for the fluid feed to be supplied with fluid to which carbonic acid is added by a carbonator. It is conceivable for the carbonator to be part of the beverage preparation machine, and wherein the carbonator has a receptacle for a $CO_2$ cartridge and a feeding device for adding $CO_2$ from the $CO_2$ cartridge to the fluid. Advantageously, it is thus also possible to produce carbonated soft drinks with the system. Alternatively, it would also be conceivable for the carbonator to have an external $CO_2$ connection.

A further subject matter of the present invention is a method for producing the cartridge system according to the invention, wherein in a first method step an aluminum sheet is provided, wherein in a second method step the main body is at least partially produced from the sheet by punching and deep drawing or impact extrusion, wherein in a third method step a sealing element is attached to the main body, and wherein in a fourth method step the main body is connected to the cartridge receptacle. The method according to the invention enables a comparatively stable cartridge to be produced quickly and inexpensively, allowing shorter reference times and higher carbon dioxide contents.

According to a further preferred embodiment of the present invention, provision is made for the cartridge receptacle to be manufactured by injection molding of plastic in an intermediate step carried out before the fourth method step. In a preferred manner, that part of the cartridge system which is not subjected to high pressurization by the introduction of compressed air is thus manufactured in plastic by a low-cost manufacturing process, whereby the overall manufacturing costs can be kept low.

According to a further preferred embodiment of the present invention, provision is made for a piercing spike to be produced in a further intermediate step carried out before or after the fourth method step and to be inserted into a spike guide of the cartridge receptacle.

According to a further preferred embodiment of the present invention, provision is made for the sealing element in the form of the sealing body to be punched and/or cut out from an aluminum sheet and/or from a sealing foil, preferably a plastic foil, an aluminum foil or a multilayer foil made of plastic and/or aluminum, in a further intermediate step carried out before the third method step. If an aluminum sheet is used, in particular the sheet is then deep-drawn in the second method step such that the sealing body of the sealing element formed from the aluminum sheet preferably has a wall thickness in its typical wall region of between 0.09 and 0.5 millimeter, preferably between 0.1 and 0.3 millimeter, particularly preferably between 0.15 and 0.25 millimeter and very particularly preferably of essentially 0.2 millimeter, in particular with a maximum error tolerance of 15%.

According to a further preferred embodiment of the present invention, provision is made for the partial area in the sealing body to be partially punched in the further intermediate step in order to form the pre-punching. The pre-punching thus defines the subsequent through-opening, which in the initial state is closed by the partial area still connected to the remaining sealing body and is only opened by the piercing spike immediately before or during beverage production.

According to a further preferred embodiment of the present invention, provision is made for the sealing element to be formed around an edge of the cartridge wall in a further intermediate method step carried out before or during the third method step. This forming can be carried out both in the variant in which the sealing element comprises the sealing body made of a rigid or semi-rigid aluminum, and in the variant in which the sealing element consists exclusively of the sealing foil.

According to a further preferred embodiment of the present invention, provision is made for the sealing element to be crimped, bonded, sealed and/or welded to the edge of the cartridge wall during the third method step. In the variant in which the sealing element comprises the sealing body made of a rigid or semi-rigid aluminum, the sealing body is in particular crimped to the cartridge wall. In the variant in which the sealing element consists exclusively of the sealing foil, the sealing foil is in particular bonded, sealed and/or welded to the cartridge wall.

According to a further preferred embodiment of the present invention, provision is made for a fastening region of the sealing element to be arranged between the edge of the cartridge wall and a part of the cartridge receptacle during the fourth method step and, in particular, to be clamped, welded and/or bonded in place. Preferably, the fastening region is thus additionally fastened by the connecting and mating connecting means.

According to a further preferred embodiment of the present invention, provision is made for a through-opening to be created in the sealing element in a further intermediate step, in particular for the through-opening to be drilled in the sealing element, and for the through-opening to be closed with a sealing foil in a later further intermediate step, wherein the sealing foil is preferably bonded, welded and/or sealed to the sealing element. This embodiment relates to the variant in which the sealing element comprises the sealing body made of a rigid or semi-rigid aluminum. This sealing body is provided with the through-opening, which is closed in the later intermediate step by the perforable sealing foil. This sealing foil can be arranged and fastened to the sealing body on the side of the mixing chamber or arranged and fastened to the sealing body on the side of the reservoir.

According to a further preferred embodiment of the present invention, provision is made for a connecting means, in particular a latching bead, a latching bulge or an undercut, to be produced in the cartridge wall, in particular by forming, during or after the second method step. Furthermore, before the fourth method step and in particular during injection molding of the cartridge receptacle, a mating connecting means, in particular a latching bead, a latching bulge or an undercut, is then preferably produced on the cartridge receptacle. In this way, it is then optionally possible for a fastening region of the sealing element to be arranged between the connecting means and the mating connecting means during the fourth method step and in particular to be clamped, welded in and/or bonded in.

The cup-shaped main body is preferably produced completely by deep drawing or impact extrusion in the second method step. Preferably, the main body is cup-shaped with a cylindrical cartridge wall which is closed on one side by a cartridge bottom, wherein the cartridge wall and the cartridge bottom are in particular formed in one piece. It is conceivable that the cartridge wall and the cartridge bottom are made from one piece and in particular both from aluminum, in that the main body is deep-drawn from a sheet of aluminum. As an alternative to deep drawing or impact extrusion, however, the main body can also be produced only partially by deep drawing or impact extrusion, in that an aluminum sheet is bent to form a cylindrical tube and then the abutting sides of the aluminum sheet bent to form the tube are bonded, welded and/or pressed together, so that a main body with longitudinal seam is produced, wherein the cartridge bottom is then additionally formed as a separate lid body by deep drawing or impact extrusion of a further aluminum sheet. This cartridge bottom, which is configured as a separate lid body, can then be slipped over that end of the cartridge wall which is bent towards the tube and faces away from the cartridge receptacle, where it can be circumferentially bonded, welded and/or pressed to the cartridge wall. In particular, the lid body is crimped onto the tubular cartridge wall to form the cartridge bottom.

Further details, features and advantages of the invention are apparent from the drawings, and from the following description of preferred embodiments with reference to the drawings. The drawings illustrate merely exemplary embodiments of the invention which do not limit the essential concept of the invention.

EMBODIMENTS OF THE INVENTION

In the various figures, identical parts are always provided with the same reference signs and are therefore each generally also mentioned only once.

Figure 1A:
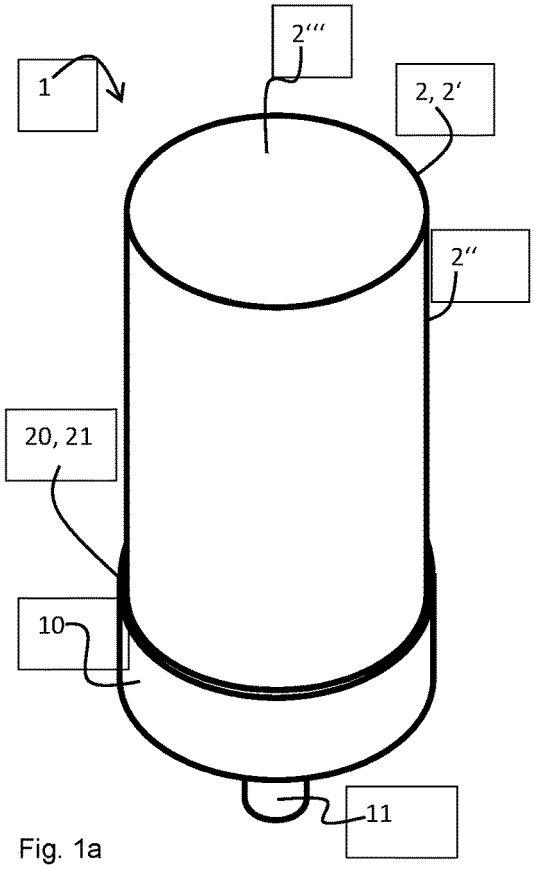
FIGS. 1*a*, 1*b* und 1*c* show a perspective view, a schematic sectional view and the general operating principle of a cartridge system according to an exemplary first embodiment of the present invention.
Figure 1B:
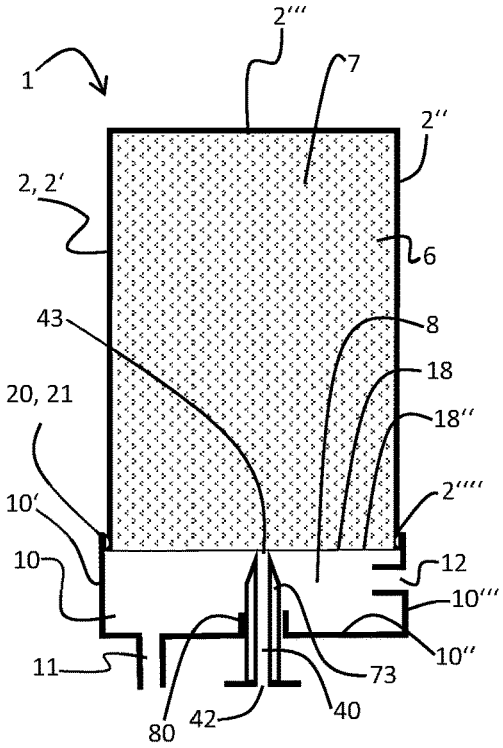
Figure 1C:
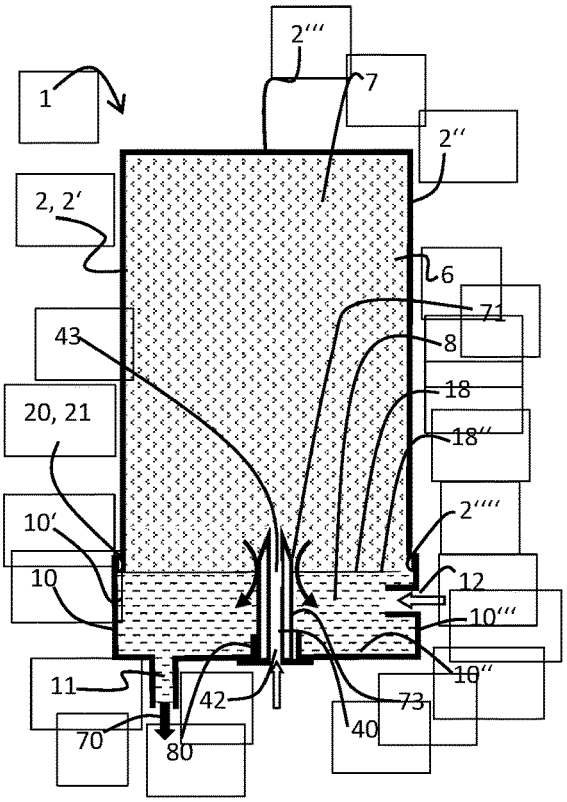

FIGS. 1*a*, 1*b* and 1*c* show a perspective view, a schematic sectional view and the general operating principle of a cartridge system 1 according to an exemplary first embodiment of the present invention.

The cartridge system 1 shown is provided to be inserted into a beverage preparation machine (not shown) for preparing a beverage 70. For this purpose, the cartridge system 1 has a cartridge 2, which is filled with a particular beverage substance 7, and a cartridge receptacle 10 connected to the cartridge 2. Within the beverage preparation machine 3, a corresponding beverage 70 is created with the aid of the beverage substance 7 and an additional water source, referred to as fluid source 41 in the following text. The cartridge 2 is in this case preferably filled with a preportioned quantity of beverage substance 7 which is necessary for creating a specific drinking portion, for example a drinking glass filling of the desired beverage 70. The beverage substance 7 is in particular a liquid and carbonated beverage concentrate in the form of syrup.

In principle, a plurality of different cartridge systems 1 are available, the cartridges 2 or reservoirs 6 of which are filled with different beverage substances 7 to produce different beverages 70. When the user of the system 1 wishes to drink a particular beverage 70, all he needs to do is choose, from the plurality of different cartridge systems 1, that cartridge system 1 which contains the corresponding beverage substance 7 for producing the desired beverage 70, insert it into a retaining unit of the beverage preparation machine and start the beverage production process at the beverage preparation machine, for example by pressing a start button, by touching a touch sensitive display in an appropriate manner, by gesture or voice control, or by means of a suitable application on a cell phone. It is also conceivable for the beverage production process to start automatically when the insertion of a new cartridge system 1 into the retaining unit 90 is detected. In each of the abovementioned cases, the desired beverage 70 is then produced automatically, conveyed into a drinking vessel and thus provided to the user. Subsequently, the used-up cartridge system 1 is removed and disposed of. The beverage preparation machine 3 is now ready once again to be filled with any desired new cartridge system 1 in order to produce a further beverage 70.

The beverage substance 7 comprises preferably liquid premixing constituents for soft drinks, such as caffeinated, carbonated, fruity and/or sugary sodas and juices, beer (mixed) drinks, or other alcoholic or nonalcoholic (mixed) drinks.

The cartridge system 1 comprises a cartridge 2 in the form of a cylindrical container. The container is hollow and thus contains a reservoir 6 for the beverage substance 7. The cartridge 2 is formed by a main body 2' made of aluminum, which is cup-shaped. Cup-shaped means here that the main body 2' has a cartridge bottom 2''' (shown above in the drawing) and a cartridge wall 2'' projecting at right angles from the cartridge bottom 2''' in the direction of the cartridge receptacle 10. In this context, the cartridge wall 2'' has a cylindrical and circumferential configuration, while the cartridge bottom 2''' in this example has a circular and disc-shaped configuration. The main body 2' is deep-drawn and punched out of an aluminum sheet during its manufacture (optionally first deep-drawn and then punched out or vice versa), so that the cartridge bottom 2''' and the cartridge wall 2'' are joined together in one piece.

On a side opposite the cartridge bottom 2''' in the axial direction, the main body 2' is closed by a sealing element 18. In the first embodiment, the sealing element 18 comprises exclusively a sealing foil 18'', in particular a thin sealing foil, which closes the reservoir 6 so that the beverage substance 7 is sealed in an aroma-tight manner. For this purpose, the outer circumferential edge region of the sealing element 18 is fixed circumferentially to the edge 2'''' of the cartridge wall 2''. Preferably, the sealing element 18 is bonded, sealed or welded here to the edge 2'''' of the cartridge wall 2''. In particular, the sealing foil 18'' comprises a plastic foil, an aluminum foil or a multilayer foil made of plastic and/or aluminum.

The cartridge 2 is firmly or reversibly connected to the cartridge receptacle 10. The cartridge receptacle 10 is connected to the cartridge receptacle 10 in particular after the main body 2' has been produced (deep drawing and punching or impact extrusion and punching), after the cartridge 2 has been filled with the beverage substance 7 and after the reservoir 6 has been closed by applying the sealing element 18. For this purpose, the cartridge wall 2'' optionally has circumferential connecting means 20, in particular in the form of a circumferential latching bead. The cartridge receptacle 10 optionally has mating connecting means 21 complementary to the connecting means 20, in particular in the form of a circumferential latching bulge, which latches into the latching bead when the cartridge 2 is connected to the cartridge receptacle 10. It is conceivable that the cartridge wall 2'' and the cartridge receptacle 10 are additionally bonded, welded and/or pressed together.

In its typical wall region, the main body 2' preferably has a wall thickness of between 0.01 and 0.5 millimeters, preferably between 0.01 and 0.2 millimeters, particularly preferably between 0.03 and 0.1 millimeters and most preferably of essentially 0.05 millimeters, in particular with a maximum error tolerance of 15%. The cartridge is then preferably configured such that it can withstand an internal pressure of up to 10 bar, particularly preferably up to 8 bar and most preferably up to 6 bar without bursting (at a temperature of 20° C. and an external pressure of 1 bar). The cartridge 2 is then preferably configured such that it can withstand an internal pressure of up to 10 bar, particularly preferably up to 8 bar and most preferably up to 6 bar without bursting (at a temperature of 20° C. and an external pressure of 1 bar). The reservoir 6 preferably has a volume of between 10 and 500 milliliters, particularly preferably between 30 and 90 milliliters and most preferably essentially 60 milliliters.

The cartridge receptacle 10 has a mixing chamber 8 which is fluidically connected to the reservoir 6 during the beverage production process, such that, with the aid of a cartridge emptying device of the cartridge receptacle 10, the beverage substance 7 can be transferred at least partially out of the reservoir 6 into the mixing chamber 8. The cartridge emptying device to this end comprises a compressed-air line 40. One end of the compressed-air line 40 is connected to a compressed-air connection 42 which can be connected to a compressed-air source of the beverage preparation machine in order to introduce compressed air into the compressed-air line 40, while the other end leads into a compressed-air outlet which is open in the direction of the reservoir 6 and introduces compressed air into the reservoir 6. The introduction of the compressed air causes the beverage substance 7 to be pushed into the mixing chamber 8.

A fluid feed 12 of the cartridge receptacle 10, which is supplied by a fluid source of the beverage preparation machine 3, also leads into the mixing chamber 8. It is conceivable for the fluid feed to have a quick coupling, by way of which the fluid feed 12 can be connected to the fluid source of the beverage preparation machine. The quick coupling can be configured for example such that, when the cartridge system 1 is inserted into the retaining unit, a fluidic connection is automatically established between the fluid source and the mixing chamber 8 via the fluid feed 12. During the beverage production process, fluid, in particular cooled and carbonated drinking water, passes from the fluid feed 12 into the mixing chamber 8 via this fluidic connection. Furthermore, during the beverage production process, beverage substance 7 passes from the reservoir 6 into the mixing chamber 8, as described above. As a result of the beverage substance 7 being blended with the fluid in the mixing chamber 8, the beverage 70 is formed, which then leaves the mixing chamber 8 through a beverage outlet 11.

The cartridge receptacle 10 has the beverage outlet 11, through which the beverage 70 produced within the mixing chamber 8 leaves the mixing chamber 8, and is conveyed in particular directly into the drinking vessel (not depicted), i.e. without parts of the beverage preparation machine coming into contact with the beverage 70. In this way, back-contamination of the beverage preparation machine 3 is prevented. The drinking vessel is arranged in particular directly beneath the beverage outlet 11.

Following completion of the beverage production process, the cartridge system 1 is removed from the retaining unit, such that the beverage production machine can be fitted with a new and unused cartridge system 1. The cartridge receptacle 10 can optionally be reused by being separated from the used cartridge 2 by releasing the latching connection, and being clipfastened onto a new cartridge 2.

To establish the fluid connection between the reservoir 6 and the mixing chamber 8, the cartridge receptacle 10 has a spike guide 80 in which a piercing spike 73 is slidably mounted. The sealing element 18 is perforated by the displaceable piercing spike 73 being transferred between a retracted position, in which the piercing spike 73 is away from the sealing element 18 (cf. FIG. 1*b*), and an extended position, in which the piercing spike 73 pierces the sealing element 18 (cf. FIG. 1*c*) and projects into the reservoir 6.

The outer wall of the piercing spike 73 is provided with the plurality of lateral channels 71 for conveying the beverage substance 7 from the reservoir 6 in the direction of the mixing chamber 8 when the sealing element 18 is pierced. The lateral channels 71 are configured in the form of grooves that are open on one side and extend parallel to one another. Following the piercing of the sealing element 18, the lateral channels 71 become fluidically connected to the reservoir 6, such that the beverage substance 7 can flow around the edges of the pierced sealing element 18 in the direction of the mixing chamber 8.

The cross section of the lateral channels 71 and/or the number of the lateral channels 71 is in this case preferably adapted to the viscosity of the beverage substance 7, such that the lateral channels 71 control or limit the flow of the beverage substance 7 in the direction of the mixing chamber 8. At a high viscosity, a plurality of lateral channels 71 and/or lateral channels 71 with a relatively large cross section are used, while, at a lower viscosity, fewer lateral channels 71 and/or lateral channels 71 with a smaller cross section are provided.

The piercing spike 73 also incorporates the compressed air line 40, which functions as a cartridge emptying device. The compressed air line 40 opens into the reservoir 6 at the end of the piercing spike 73 when the piercing spike 73 is in the extended position. On a side of the piercing spike 73 facing away from the reservoir 6 in particular, the compressed air connection 42 is formed, which can thus be accessed from outside the cartridge receptacle 10 and connected to the compressed air source of the beverage preparation machine.

Preferably, the piercing spike 73 is transferred from the retracted position to the extended position during or after insertion of the cartridge system 1 into the beverage preparation machine or after starting the beverage production process, preferably by a stationary release element of the retaining unit, against which the piercing spike 73 is pressed. The piercing spike 71 is preferably a plastic part and particularly preferably a plastic injection molded part.

Provision is preferably made for both the fluid source and the compressed-air source to be coupled directly to the fluid feed 12 and to the compressed-air connection 42, respectively, as soon as the cartridge system 1 is inserted into the beverage preparation machine or a beverage production process is started, and in particular before the sealing element 18 is pierced. In this way, back-contamination in the direction of the beverage preparation machine is effectively avoided because the fluid feed 12 and the cartridge emptying device are immediately under overpressure upon insertion of the cartridge system 1, and this prevents the beverage substance 7 from traveling in the direction of the fluid source and compressed-air source, respectively. The beverage substance 7 can thus move only in the direction of the mixing chamber 8 from the reservoir 6 as soon as the sealing element 18 is opened.

The cartridge receptacle 10 comprises a base structure 10' with a cup-shaped configuration. The open side of this cup-shaped configuration points towards the cartridge 2 and at least partially receives the cartridge 2, in particular the edge 2'''' of the cartridge wall 2''. On an opposite bottom side 10'', the base structure 10' has the beverage outlet opening 11 and the outwardly open spike guide 80. The fluid feed 12 is formed on a side wall 10'' of the basic structure 10'. The basic structure 10' is configured in particular as a plastic part and especially preferably as a plastic injection-molded part.

Figure 2:
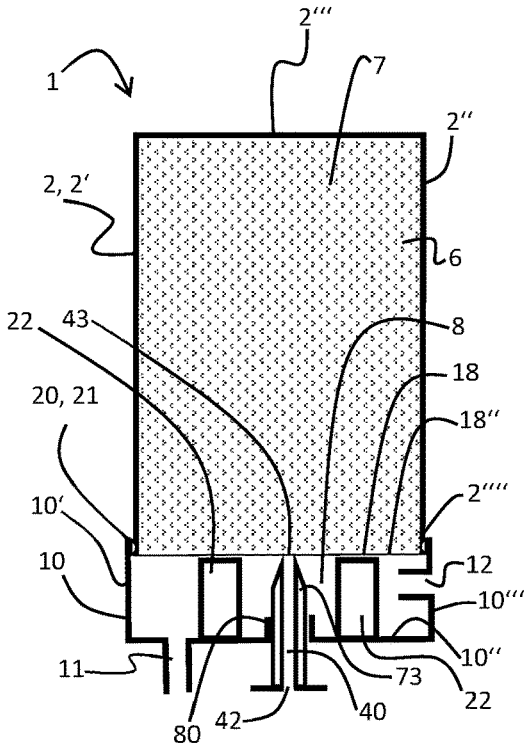
FIG. 2 shows a schematic sectional view of a cartridge system according to an exemplary second embodiment of the present invention.

FIG. 2 shows a schematic sectional view of a cartridge system 1 according to an exemplary second embodiment of the present invention. The second embodiment is similar to the first embodiment illustrated and explained with reference to FIGS. 1*a*, 1*b* and 1*c*, wherein, in contrast, the cartridge receptacle 10 additionally has support structures 22 which support the sealing foil 18''.

In the present example, the support structures 22 comprise column and support-like elements which extend from the bottom side 10'' of the base structure 10' (in particular within the mixing chamber 8) in the direction of the reservoir 6 to such an extent that the sealing foil 18' can be supported or rest on the elements and is protected from unintentional tearing, in particular during transport and storage of the cartridge system 1.

Figure 3A:
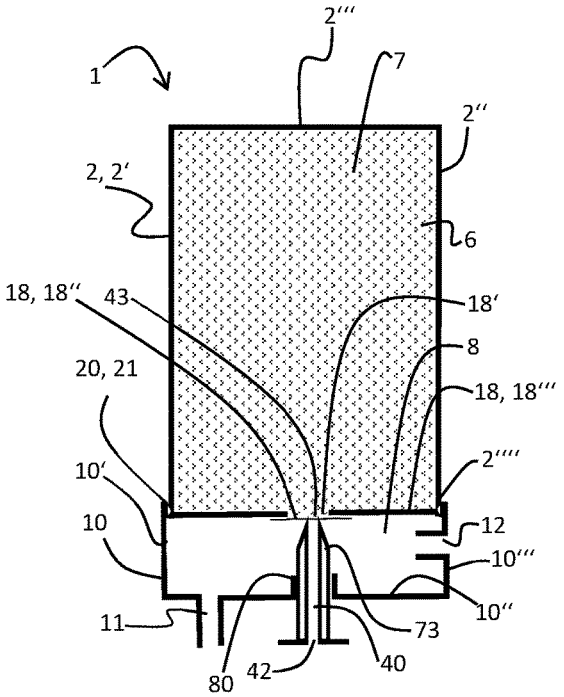
FIGS. 3*a* und 3*b* show a schematic sectional view and the general operating principle of a cartridge system according to an exemplary third embodiment of the present invention.
Figure 3B:
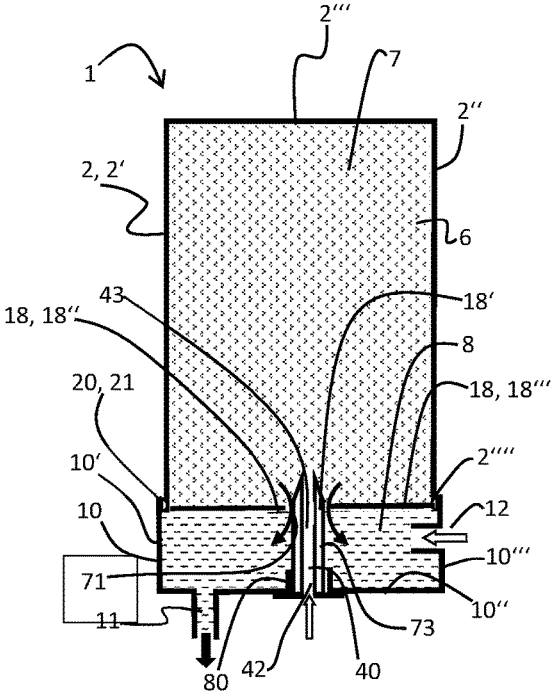

FIGS. 3*a* and 3*b* show a schematic sectional view and the general operating principle of a cartridge system 1 according to an exemplary third embodiment of the present invention. The third embodiment is similar to the first embodiment illustrated and explained with reference to FIGS. 1*a*, 1*b* and 1*c*, with the difference that the sealing element 18 does not consist exclusively of a sealing foil 18'', but comprises a rigid or semi-rigid sealing body 18''', which is made of aluminum.

The sealing body 18''' has a through-opening 18', which in the initial state of the cartridge system 1 is in turn closed by a sealing foil 18'' (see FIG. 3*a*). The through-opening 18' is arranged such that when the piercing spike 73 is transferred from the retracted position to the extended position, it protrudes through the through-opening 18', thereby piercing the sealing foil 18'' (see FIG. 3*b*). In particular, the piercing spike 73 does not come into contact with the sealing body 18'''. The sealing body 18''' can therefore be very stable.

The sealing foil 18' in turn comprises a plastic foil, an aluminum foil or a multilayer foil made of plastic and/or aluminum, the circumferential edge of which is preferably bonded, sealed and/or welded to the sealing body 18'''. The sealing foil 18' is arranged on and/or fastened to the sealing body 18''' in particular on the outside of the sealing body 18''', i.e. on the side facing the mixing chamber 8.

The sealing body 18''' is preferably crimped with its edge region to the edge 2'''' of the cartridge wall 2'' in order to fasten the sealing body 18''' to the main body 2'. It is conceivable that the cartridge wall 2'' has a circumferential web at the edge 2'''' as a connecting means 20, around which the sealing body 18''' is crimped. The sealing body 18''' thus represents a type of crimp cap.

Alternatively, it is conceivable that the sealing body 18''' is screwed to the cartridge wall 2'', thus an internal thread of the sealing body 18''' engages in an external thread on the cartridge wall 2''. The screw connection is preferably adapted such that only screwing on with subsequent latching is possible, so that subsequent unscrewing is prevented by the latching.

Alternatively, it is conceivable that the edge of the cartridge wall 2'' has a connecting means 20, in particular a latching bead, a latching bulge or an undercut, for connecting the cartridge 2 to the sealing body 18'''. Preferably, the sealing body 18''' has a mating connecting means 21 complementary to the connecting means 20, in particular a further latching bead, a latching bulge or an undercut, which is connected to the connecting means 20 in a form-fitting, force-fitting and/or material-fitting manner.

In its typical wall region, the sealing body 18''' preferably has a wall thickness of between 0.09 and 0.5 millimeters, preferably between 0.1 and 0.3 millimeters, particularly preferably between 0.15 and 0.25 millimeters, and most preferably of essentially 0.2 millimeters, in particular with a maximum error tolerance of 15%.

Figure 4:
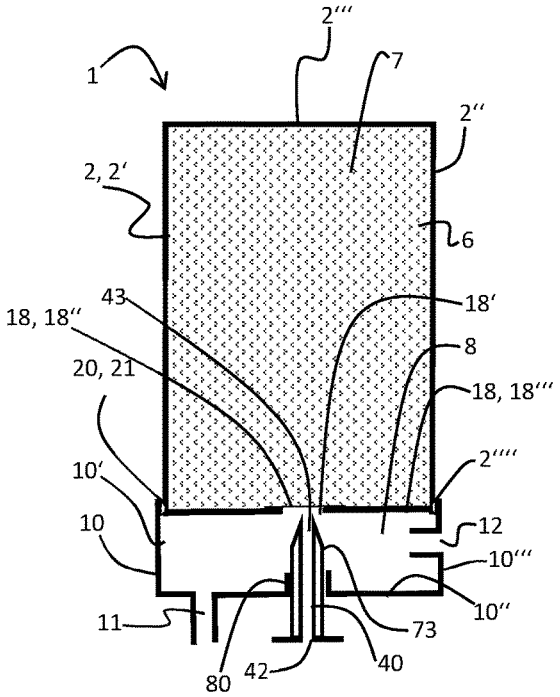
FIG. 4 shows a schematic sectional view of a cartridge system according to an exemplary fourth embodiment of the present invention.

FIG. 4 shows a schematic sectional view of a cartridge system 1 according to an exemplary fourth embodiment of the present invention. The fourth embodiment is similar to the first embodiment illustrated and explained on the basis of FIGS. 1*a*, 1*b* and 1*c*, wherein, in contrast to the third embodiment, the sealing foil 18'' is not arranged on the outside of the sealing body 18''', but wherein the sealing foil 18'' is arranged and, in particular, fastened on the inside of the sealing body 18''' facing the reservoir 6.

The sealing foil 18' again comprises a plastic foil, an aluminum foil or a multilayer foil made of plastic and/or aluminum, the circumferential edge of which is preferably bonded, sealed and/or welded to the inside of the sealing body 18'''.

Figure 5:
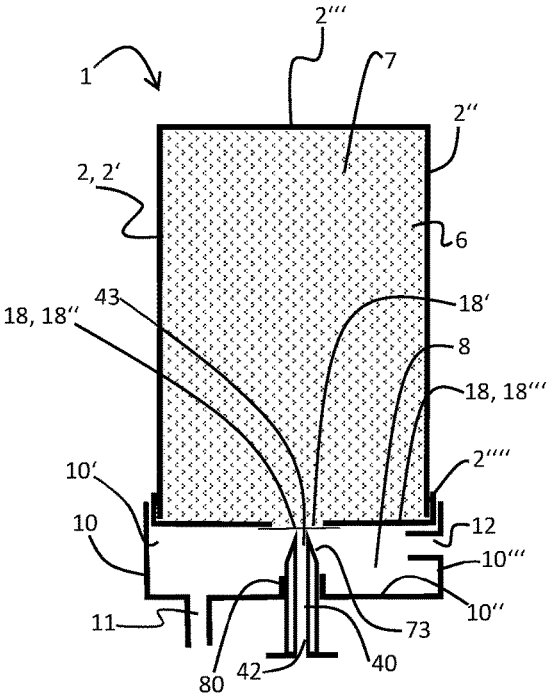
FIG. 5 shows a schematic sectional view of a cartridge system according to an exemplary fifth embodiment of the present invention.

FIG. 5 shows a schematic sectional view of a cartridge system 1 according to an exemplary fifth embodiment of the present invention. The fifth embodiment is similar to the third embodiment illustrated and explained with reference to FIGS. 3*a* and 3*b*, wherein, in contrast to the third embodiment, the sealing body 18''' has a fastening region at its edge.

This fastening region is angled at 90 degrees relative to the remaining region of the sealing body 18''' and thus extends parallel to the cartridge wall 2". There is therefore an overlap area between the fastening region and the edge 2"" of the cartridge wall 2". The sealing body 18''' is thus also cup-shaped. In the present example, the fastening region has a slightly larger radius than the edge 2"" of the cartridge wall 2", so that the fastening region is arranged at least partially between the edge 2"" of the cartridge wall 2" and the edge of the cartridge receptacle 10.

The fastening region is arranged in particular between the connecting means 20 and the mating connecting means 21 and is additionally fastened there, in particular by bonding, clamping, pressing, welding or the like.

In particular, the sealing body 18''' is formed from the aluminum sheet into its cup-shaped configuration by deep drawing or impact extrusion.

It is conceivable that the cartridge wall 2" and the cartridge receptacle 10 also have the connecting and mating connecting means 20, 21. Alternatively, these connecting and mating connecting means 20, 21 are not realized.

Figure 6:
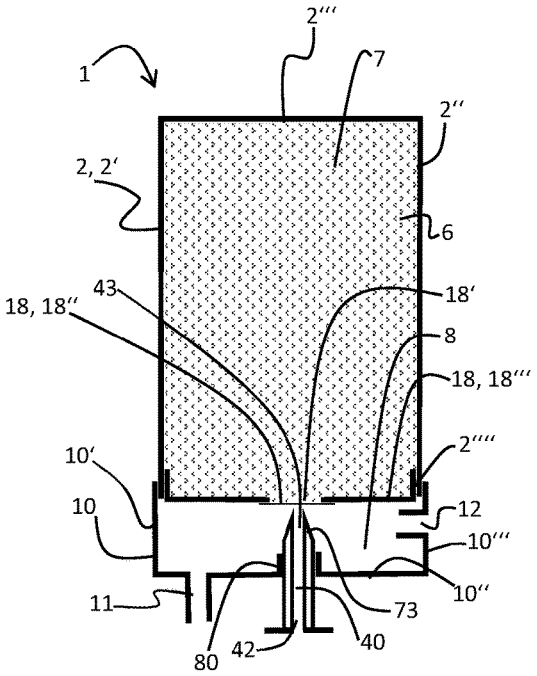
FIG. 6 shows a schematic sectional view of a cartridge system according to an exemplary sixth embodiment of the present invention.

FIG. 6 shows a schematic sectional view of a cartridge system 1 according to an exemplary sixth embodiment of the present invention. The sixth embodiment is similar to the fourth embodiment illustrated and explained with reference to FIG. 5, wherein, in contrast to the fourth embodiment, the sealing body 18''' has a smaller radius than the cartridge wall 2".

The fastening region is thus arranged on the inside of the cartridge receptacle 2", so that the edge 2"" of the cartridge receptacle 2" is arranged between the fastening region and the edge of the cartridge receptacle 10 and is fastened there, in particular by bonding, clamping, pressing, welding or the like.

It is conceivable for the cartridge wall 2" and the cartridge receptacle 10 to also have the connecting and mating connecting means 20, 21. Alternatively, these connecting and mating connecting means 20, 21 are not realized.

Figure 7:
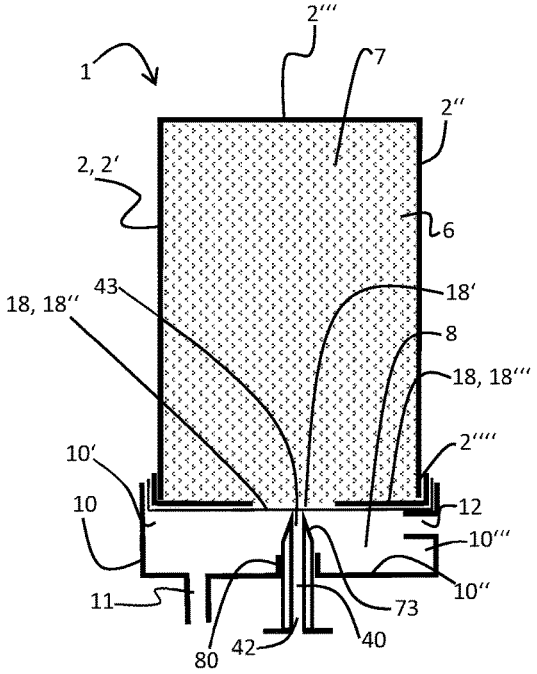
FIG. 7 shows a schematic sectional view of a cartridge system according to an exemplary seventh embodiment of the present invention.

FIG. 7 shows a schematic sectional view of a cartridge system 1 according to an exemplary sixth embodiment of the present invention. The sixth embodiment is similar to the fourth embodiment illustrated and explained with reference to FIG. 5, wherein, in contrast to the fourth embodiment, the sealing foil 18" extends to the fastening region.

Figure 8A:
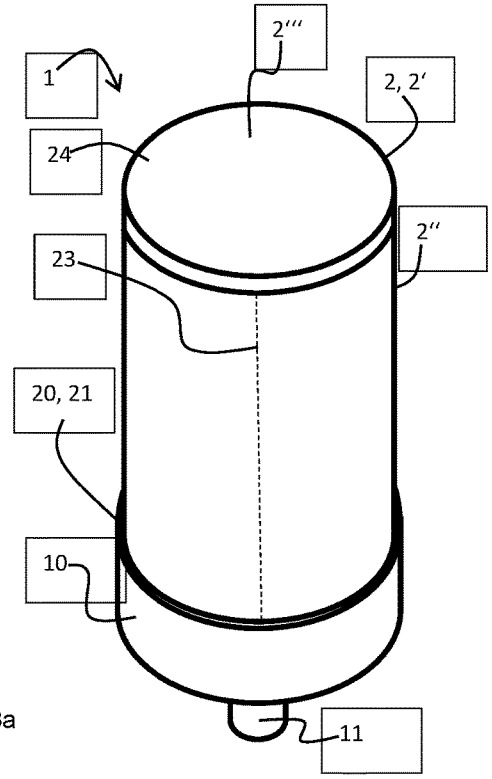
FIGS. 8*a* und 8*b* show a perspective view and a schematic sectional view of a cartridge system according to an exemplary eighth embodiment of the present invention.
Figure 8B:
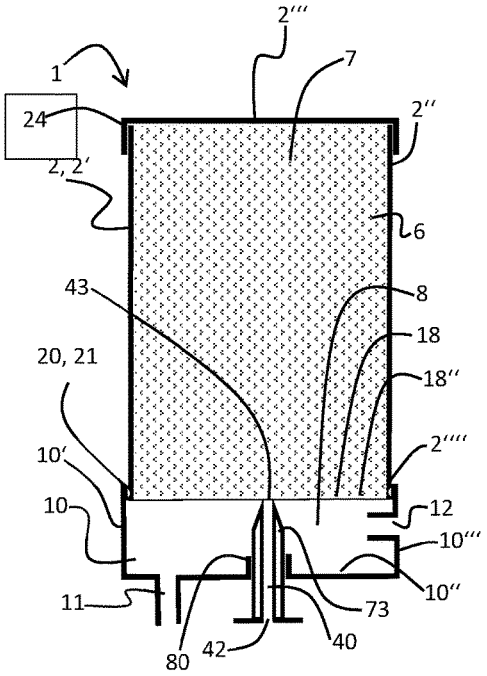

FIGS. 8*a* and 8*b* show a perspective view and a schematic sectional view of a cartridge system 1 according to an exemplary eighth embodiment of the present invention. The eighth embodiment is similar to the first embodiment illustrated and explained with reference to FIGS. 1*a*, 1*b* and 1*c*, wherein, in contrast, the main body 2' is not manufactured by a deep-drawing process.

The main body 2' therefore also does not consist of a cartridge wall 2" and a cartridge bottom 2", which are integrally connected to one another. In the eighth embodiment, the main body 2' is formed by bending an aluminum sheet into a cylindrical tube. The abutting sides of the sheet bent into the tube are then bonded, welded or pressed together, forming a longitudinal seam 23.

In addition, the cartridge bottom 2" is formed as a separate lid body 24, in particular by deep drawing or impact extrusion of a further aluminum sheet. This cartridge bottom 2", formed as a separate lid body 24, is then slipped over that end of the cartridge wall 2" bent into the tube which faces away from the cartridge receptacle 10, where it is circumferentially bonded, welded and/or pressed to the cartridge wall 2". In particular, the lid body 24 is crimped onto the tubular cartridge wall 2" to form the cartridge bottom 2".

Depending on the embodiment of the sealing element, the subsequent manufacturing steps may optionally be carried out as in any of the other embodiments described above (first to seventh embodiments).

Figure 9A:
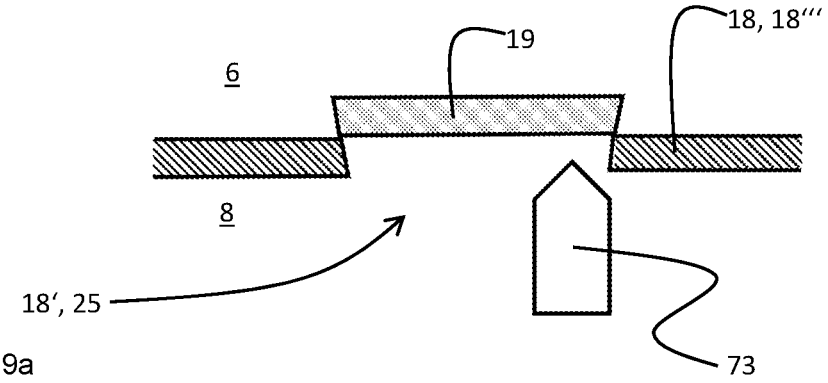
Figure 9B:
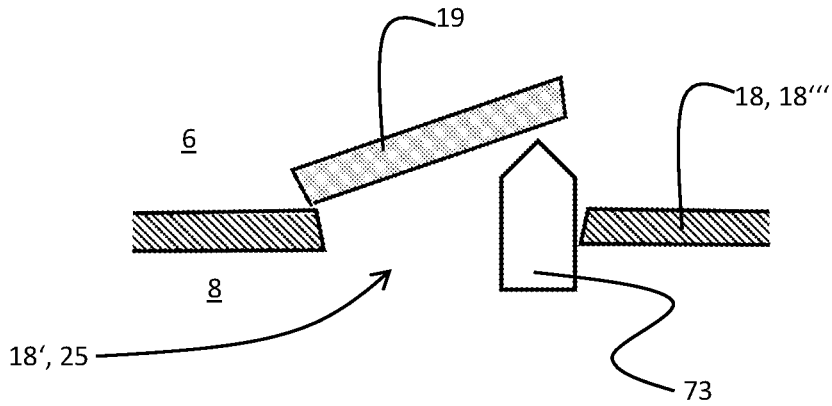

FIGS. 9*a* and 9*b* respectively show a schematic sectional view and a detailed view of the sealing element 18 of the cartridge system 1 according to an exemplary ninth embodiment of the present invention. The ninth embodiment is similar to the third embodiment illustrated and explained with reference to FIGS. 3*a* and 3*b*, although in contrast the sealing element 18 does not comprise a sealing foil 18", but only comprises the sealing body 18'''. The sealing body 18''' is again rigid or semi-rigid and is made of aluminum.

The sealing body 18''' has a pre-punched hole 27, in which a partial area 19 of the sealing body 18''' is partially pre-punched out of the sealing body 18'''. However, this partial area 19 is not completely punched out by the pre-punched hole 25, but only partially punched out, so that it still remains integrally connected to the remaining sealing body 18''' in its corner areas and seals the reservoir 6 with respect to the mixing chamber 8. This initial state (also referred to as the delivery state of the cartridge) is illustrated in FIG. 9*a*.

Due to the pre-punched hole 25 of the sealing element 18 or sealing body 18''', the sealing body 18''' has a weakened or predetermined breaking point in the edge region of the partial area 19. If now, before or during the beverage production, the piercing spike 73 hits the partial area 19 and presses it in the direction of the reservoir 6, the connection between the partial area 19 and the remaining sealing body 19 at least partially tears or collapses, whereby the through-opening 18' is formed, in particular according to the size of the pre-punched hole 25.

Due to the fact that the partial area 19 is punched out of the sealing body 18''', it has essentially the identical size or diameter as the through-opening 18', in which the piercing spike 73 is additionally arranged during beverage production. This advantageously prevents the detached partial area 19 from passing through the through-opening 18' into the mixing chamber 8.

LIST OF REFERENCE SIGNS

1 Cartridge system
2 Cartridge
2 Main body
2" Cartridge wall
2''' Cartridge bottom
2""Edge of the cartridge wall
6 Reservoir
7 Beverage substance
8 Mixing chamber
10 Cartridge receptacle
10'Base structure
10" Bottom side
10''' Side wall of the base structure
11 Beverage outlet
12 Fluid feed
18 Sealing element
18' Through-opening
18' Sealing foil

18''' Sealing body
19 Partial area
20 Connecting means
21 Mating connecting means
22 Support structure
23 Longitudinal seam
24
Lid body
Pre-punched hole
25
40 Compressed-air line
42 Compressed-air connection
43 Compressed-air outlet
71 Lateral channel
70 Beverage
73 Piercing spike
80 Spike guide

The invention claimed is:

1. A method for producing a cartridge system for producing a beverage, wherein the cartridge system is insertable into a beverage preparation machine, has a cartridge which comprises a reservoir filled with a beverage substance, and has a cartridge receptacle connected to the cartridge, wherein the cartridge receptacle has a mixing chamber which can be fluidically connected to the reservoir and a fluid feed opening into the mixing chamber, wherein the cartridge is at least partially made of aluminum, wherein in a first method step, an aluminum sheet is provided, wherein, in a second method step, a main body is generated at least partially from the aluminum sheet by punching and either (i) deep-drawing or (ii) impact extrusion, wherein, in a third method step, a sealing element is attached to the main body, and wherein, in a fourth method step, the main body is connected to the cartridge receptacle.

2. The method as claimed in claim 1, wherein in an intermediate step carried out before the fourth method step, the cartridge receptacle is produced by injection molding of plastic.

3. The method as claimed in claim 1, wherein in a further intermediate step carried out before or after the fourth method step, a piercing spike is produced and inserted into a spike guide of the cartridge receptacle.

4. The method as claimed in claim 1, wherein, in a further intermediate step carried out before the third method step, the sealing element in a form of a sealing body is punched out and/or cut out from an aluminum sheet and/or from a sealing foil.

5. The method as claimed in claim 4, wherein in the further intermediate step a partial area in the sealing body is partially punched to form a pre-punched hole.

6. The method as claimed in claim 4, wherein the sealing foil is a plastic foil, an aluminum foil, or a multilayer foil made of plastic and/or aluminum.

7. The method as claimed in claim 1, wherein in a further intermediate step carried out before or during the third method step, the sealing element is formed around an edge of a cartridge wall.

8. The method as claimed in claim 1, wherein during the third method step the sealing element is crimped, bonded, sealed, and/or welded to an edge of a cartridge wall.

9. The method as claimed in claim 1, wherein during the fourth method step a fastening region of the sealing element is arranged between an edge of a cartridge wall and a part of the cartridge receptacle and in particular is clamped, welded, and/or bonded in place.

10. The method as claimed in claim 1, wherein in a further intermediate step a through-opening is created in the sealing element, and wherein the through-opening is closed with a sealing foil in a later further intermediate step, wherein the sealing foil is preferably bonded, welded, and/or sealed to the sealing element.

11. The method as claimed in claim 10, wherein the through-opening is created in the sealing element by drilling into the sealing element.

12. The method as claimed in claim 1, wherein during or after the second method step is performed in a further intermediate step a connecting means is produced in a cartridge wall, in particular by forming.

13. The method as claimed in claim 12, wherein the connecting means is a detent bead, a detent bulge, or an undercut.

14. The method as claimed in claim 1, wherein prior to the fourth method step and in particular during injection molding of the cartridge receptacle, a mating connecting means is created on the cartridge receptacle.

15. The method as claimed in claim 14, wherein the mating connecting means is a detent bead, a detent bulge, or an undercut.

16. The method as claimed in claim 1, wherein during the fourth method step a fastening region of the sealing element is arranged between a connecting means and a mating connecting means and is in particular clamped, welded, and/or bonded in place.

17. The method as claimed in claim 16, wherein the connecting means is a detent bead, a detent bulge, or an undercut; and wherein the mating connecting means is a detent bead, a detent bulge, or an undercut.

* * * * *